US007121018B2

(12) United States Patent
Lee

(10) Patent No.: US 7,121,018 B2
(45) Date of Patent: Oct. 17, 2006

(54) DRYER, AND DRAIN STRUCTURE OF THE SAME

(75) Inventor: Jun Seok Lee, Daegu-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/017,834

(22) Filed: Dec. 22, 2004

(65) Prior Publication Data

US 2005/0138831 A1 Jun. 30, 2005

(30) Foreign Application Priority Data

Dec. 26, 2003 (KR) ..... 10-2003-0097563

(51) Int. Cl.
*F26B 11/02* (2006.01)

(52) U.S. Cl. ..... 34/595; 34/604; 68/12.27

(58) Field of Classification Search ..... 34/595, 34/596, 602, 603, 604; 68/12.27
See application file for complete search history.

(56) References Cited

U.S. PATENT DOCUMENTS 2,742,708 A * 4/1956 McCormick ..... 34/76
3,805,404 A * 4/1974 Gould ..... 34/75
3,858,330 A * 1/1975 De Pas ..... 34/75
3,915,596 A * 10/1975 Frazar ..... 417/423.1
4,154,003 A * 5/1979 Muller ..... 34/469
4,447,965 A * 5/1984 Bray ..... 34/416
6,868,689 B1 * 3/2005 McNeil et al. ..... 62/285

FOREIGN PATENT DOCUMENTS

| | | |
|---|---|---|
| DE | 3148573 A1 | 6/1983 |
| DE | 100 02 742 C1 | 6/2005 |
| EP | 0 429 953 A2 | 6/1991 |
| IT | 1173472 A1 | 6/1987 |

* cited by examiner

*Primary Examiner*—S. Gravini
(74) *Attorney, Agent, or Firm*—Birch, Stewart, Kolasch & Birch, LLP

(57) ABSTRACT

A dryer and a drain structure of the same are provided. The drain structure of a dryer includes a base, a condenser mounted on the base, and a drain concaved from front to rear of a condenser mounting surface, which is provided on the base and mounts the condenser thereon.

21 Claims, 6 Drawing Sheets

DRYER, AND DRAIN STRUCTURE OF THE SAME

BACKGROUND OF THE INVENTION

1. Field of the Invention

The present invention relates to a dryer, and more particularly, to a drain structure for exhausting condensate water from a front sealing mounting surface. Much more particularly, the present invention relates to a drain structure for condensate water in which the condensate water is prevented from being leaked out.

2. Description of the Related Art

Dryer sends hot air, which is generated by an electric heater, a gas combustion device or the like, inside of a drum to eliminate remnant moisture from a target object such as clothing, thereby drying the target clothing.

The dryer includes a drum rotating with the clothing housed therein; a motor for rotating the drum; a heater for heating the air; a circulation fan for circulating the air; an air passage structure for flowing the air; and a condensate water drain structure for exhausting high humid air to the exterior.

In detail, the air passage structure is divided into two air passages. That is, there are a first air passage and a second air passage. In the first air passage, the air is circulated within the dryer while moisture is absorbed from a drum and condensed. In the second air passage, an exterior cold air is introduced and used for the condensing of the condensate water, and then is exhausted out. Additionally, a condenser is provided to heat-exchange the air flowing the first air passage and the second air passage to generate the condensate water.

Meanwhile, the conventional dryer has a drawback in that the condensate water is leaked out. This drawback is mainly caused when the air of the first air passage not introduced to the condenser is condensed at a periphery of the condenser. In other words, the condensate water is leaked out from the periphery of the condenser.

The conventional dryer has a drawback in that the leaked condensate water contaminates an interior environment, and further causes an anxiety concerning an electric shock due to a contact with wiring.

SUMMARY OF THE INVENTION

Accordingly, the present invention is directed to a dryer and a drain structure of the same that substantially obviate one or more problems due to limitations and disadvantages of the related art.

An object of the present invention is to provide a dryer and a drain structure of the same in which condensate water condensed at a periphery of a condenser is not leaked out from the dryer, and is exhausted out together with condensate water normally condensed in the condenser.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dryer including: a cabinet; a drum housed inside of the cabinet; a motor for providing a rotary force to the drum; a belt for connecting a driving shaft of the motor with the drum; a base disposed at a lower side of the drum; a condenser mounted on the base, and allowing a high humid air passing through the drum and an indoor cold air to be in contact with each other to provide condensate water; and a drain lengthwise concaved from front to rear of a condenser mounting surface, which is provided on the base and mounts the condenser thereon, for draining the condensate water from a periphery of the condenser.

In another aspect of the present invention, there is provided a drain structure of a dryer, the structure including: a base; a condenser mounting surface provided to have a predetermined depth from front to rear of the base, and mounting a condenser thereon; a front sealing mounting surface provided in front of the condenser mounting surface, and positioned to be lower than the condenser mounting surface; and at least one drain having a depth at least corresponding to a step between the condenser mounting surface and the front sealing mounting surface, and lengthwise provided from front to rear of the condenser mounting surface.

In a further aspect of the present invention, there is provided a drain structure of a dryer, the structure including: a base; a condenser mounted on the base; and a drain concaved from front to rear of a condenser mounting surface, which is provided on the base and mounts the condenser thereon.

The present invention has an effect in that the condensate water condensed within the dryer is not leaked out from the dryer, and can be exhausted outside together with the condensate water normally drained.

Further, the present invention has an effect in that an anxiety concerning an environmental contamination or an electric shock caused by the leaked condensate water is eliminated.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
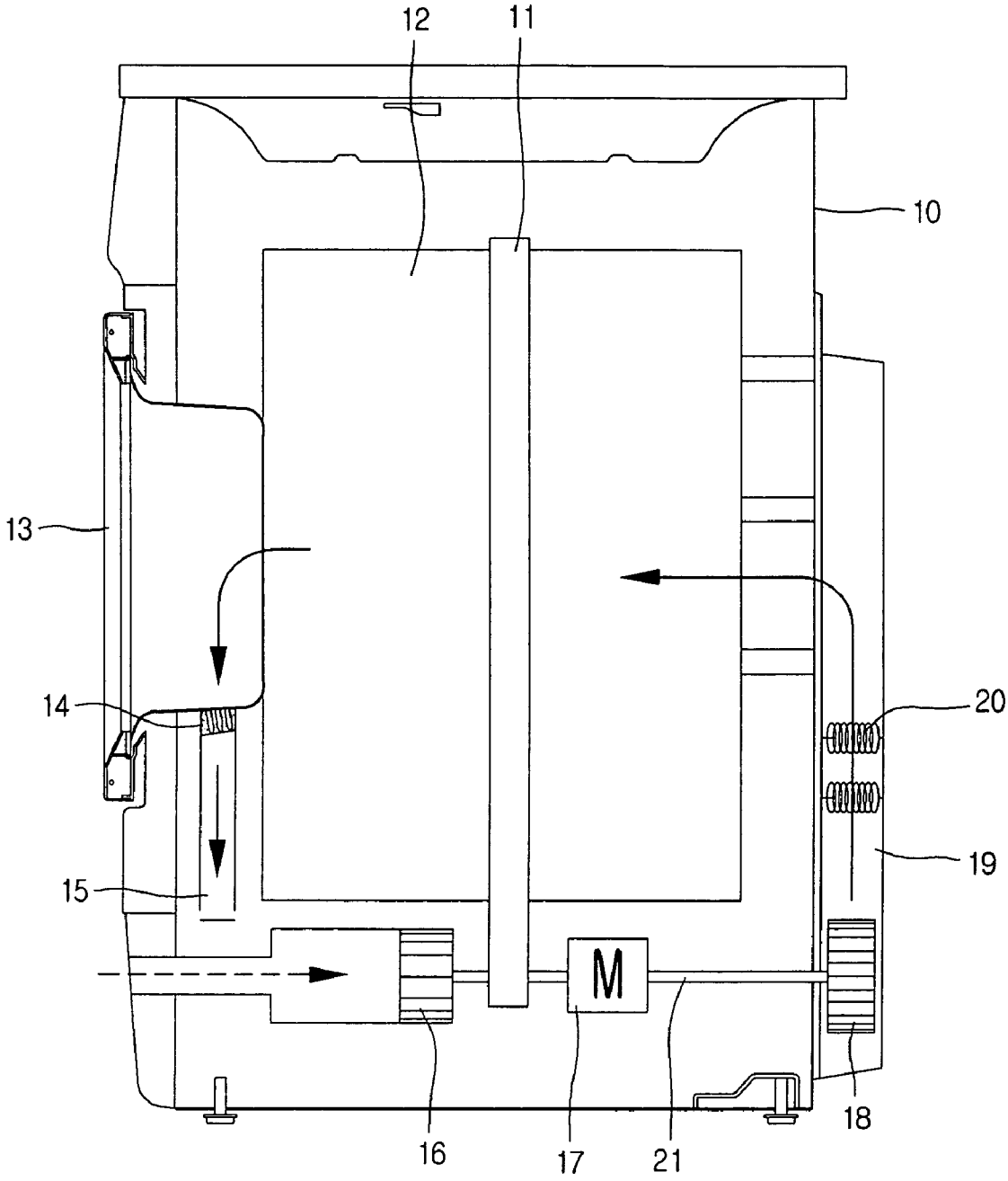
FIG. 1 is a side view illustrating a condenser-type drum dryer according to the present invention.

FIG. 1 is a side view illustrating a condenser-type drum dryer according to the present invention.

Referring to FIG. 1, the condenser-type drum dryer includes a cabinet 10 providing an exterior appearance; a cylindrical drum 12 disposed inside of the cabinet 10; a door 13 for opening and closing the drum 12; and a belt 11 wound around the drum 12.

Further, the dryer includes a motor shaft 21 connected with the belt 11; a motor 17 connected with the motor shaft 21 to provide a rotary force; a cooling fan 16 connected to the motor shaft 21 to rotate by the motor 17 while introducing an indoor air.

Furthermore, the dryer includes a drying fan 18 connected with the motor shaft 21 to face with the cooling fan 16, thereby circulating the air in the drum; and a drying duct 19 having a heater 20 disposed therein and functioning as a passage for moving the intake air to the drum 12.

Figure 2:
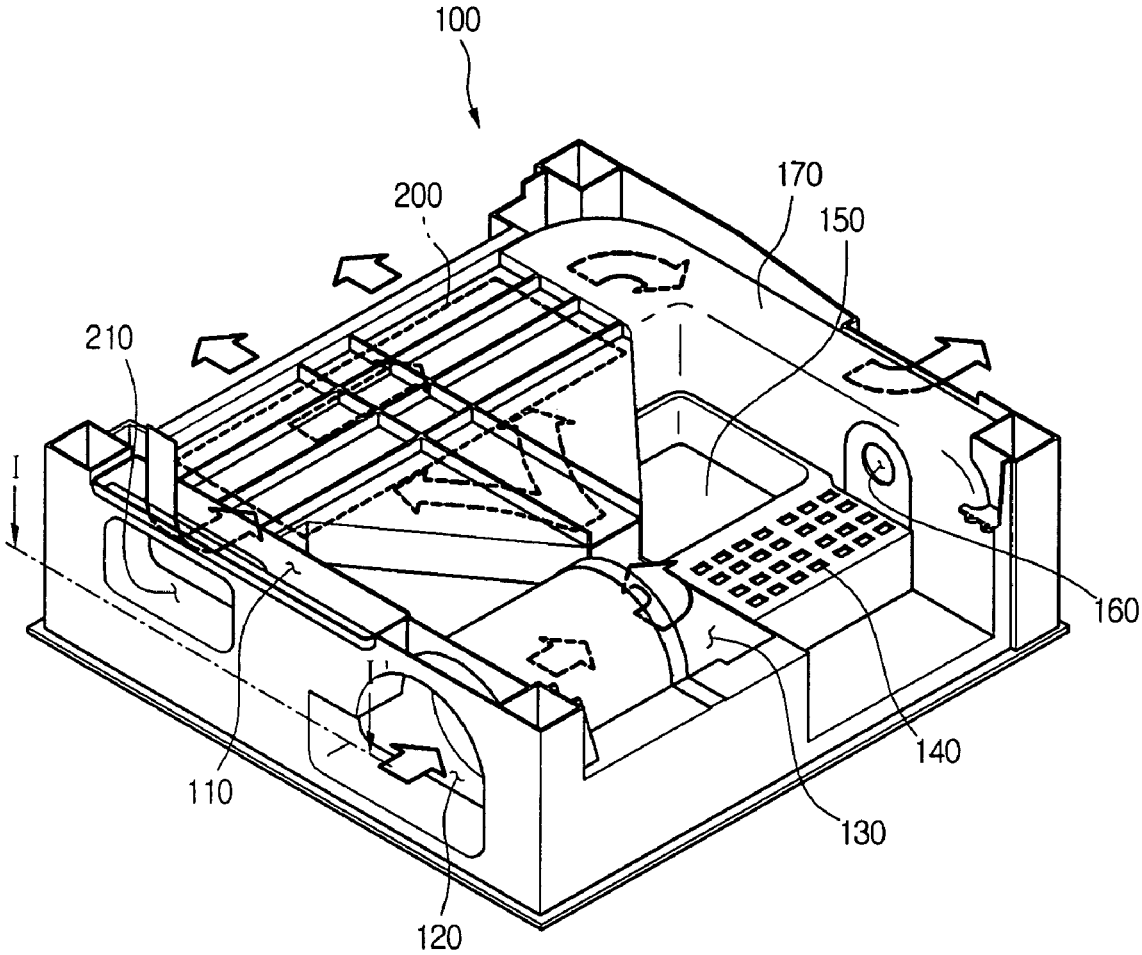
FIG. 2 is a perspective view illustrating a base of a dryer according to the present invention.

Furthermore, the dryer includes a lint filter 14 disposed at a lower side of an opening part into which the door 13 is inserted, to filter a foreign substance such as nap from a humid air exhausted from the drum; and a circulation duct 15 functioning as a passage for moving the air introduced into the lint filter 14, to the condenser (reference numeral 200 of FIG. 2).

Hereinafter, an operation of the dryer according to the present invention is described.

First, if power is applied to the dryer, the motor 17 is rotated, and a heater 20 dissipates a heat in the drying duct 19. Additionally, the belt 11 connected to the motor shaft 21 is rotated to rotate the drum 12. Additionally, as the drum 12 rotates, the laundry disposed inside the drum is rotated together with and along an inner wall of the drum, and the laundry drops by self-weight at a top of the drum. Here, the laundry is raised using a lifter (not shown) disposed at the inner wall of the drum.

Meanwhile, the drying fan 18 connected to the motor shaft 21 is operated at the same time of the rotation of the motor 17, to introduce the circulated air passing through the lint filter 14. As the intake air rises along the drying duct 19, the intake air becomes a high-temperature and dry air via the heater 20. Additionally, the high-temperature and dry air passes through the drum while absorbing the moisture from the laundry to become a high-temperature and humid air.

Further, the high-temperature and humid air is again filtered by the lint filter 14, and then directed to the condenser 200 depending on the circulation duct 15.

Furthermore, when the cooling fan 16 connected to the motor shaft 21 is rotated, the cooling fan 16 introduces the indoor air from the exterior. Additionally, the intake indoor air is introduced into the condenser via the cooling fan 16.

Here, the high-temperature and humid air directing to the condenser along the circulation duct 15, and the indoor air introduced by the cooling fan 16 and directing to the condenser 200 are intersected with each other when they pass through the condenser. Additionally, the high-temperature and humid air and the indoor air are not mixed with each other but heat-exchanged due to a configuration of the condenser.

Accordingly, while the high-temperature and humid air passes through the condenser, it gives a heat to the indoor air, thereby becoming a low-temperature and humid air. Additionally, when the high-temperature and humid air is decreased in temperature, the high-temperature and humid air is condensed and condensed water is dropped to a floor of the condenser, thereby being directed to a condensate water storage unit (reference numeral 150 of FIG. 2) for collecting the condensed water. Additionally, the moisture is moved from the condensate water storage unit 150 to a predetermined case positioned at an upper side of the dryer, by a condensation pump.

The condenser 200 is inserted from front to rear of the dryer. In order to insert the condenser 200 from front of the dryer, a portion of the base 100 is opened at its front. After the condenser 200 is inserted, the opening part (reference numeral 210 of FIG. 2) is sealed by a predetermined front sealing member. Meanwhile, since the opening part 210 functions as an air passage through which the humid air passing through the drum passes, the opening part 210 collects the condensate water at its periphery.

Hereinafter, the present invention is in detail described with reference to a structure of the base on which the condenser 200 is mounted.

FIG. 2 is a perspective view illustrating the base of the dryer having the inserted condenser according to the present invention.

Referring to FIG. 2, the base 100 of the dryer includes a circulation air falling part 110 for falling internal air passing through the door-side lint filter via the drum; the condenser 200 lengthwise inserted to a rear side of the base through the opening part 210 disposed at a lower side of the circulation air falling part 110; and a circulation air passage 170 disposed at a rear side of the condenser 200 to move the air from the condenser 200.

Further, the base 100 includes an indoor air suction port 120 at its front right side to allow the indoor air to be sucked therethrough; and a cooling fan mounting groove 130 for mounting the cooling fan to suck the indoor air.

Furthermore, the motor is mounted at a rear side of the cooling fan mounting groove 130 to provide a driving force, thereby rotating the drum, and a motor heat sink groove 140 is provided to eliminate the heat from the motor.

Additionally, the condensate water storage unit 150 is provided at approximate center of the base 100 to collect the condensate water from the condenser 200.

Hereinafter, a fluid circulation generated within the base 100 is briefly described.

As described above, the high-temperature and humid internal air passing through the lint filter provided at the door and a tub cover passes through the condenser 200 via the circulation air falling part 110. Further, the indoor air sucked through the indoor air suction port 120 passes through the condenser 200 via the cooling fan. Here, since the indoor air has a lower temperature than the circulation air, the indoor air is heat-exchanged while passing through the condenser 200.

Additionally, the circulation air passing through the condenser 200 moves along the circulation air passage 170 to move to the drying duct 19 provided at a rear wall of the dryer. Additionally, the indoor air passing through the condenser 200 is again exhausted inside.

Further, the circulation air and the indoor air passing through the condenser 200 are not mixed with each other, but are only heat-exchanged. For this, the circulation air passage and the indoor air passage are constructed to intersect with each other within the condenser 200.

Alternatively, the high humid air is introduced into the opening part 210 through the circulation air falling part 110. At this time, there is a drawback in that the high humid circulation air can be condensed and leaked out. In order to solve this drawback, the present invention is characterized in that a predetermined depth of passage is additionally provided at a condenser mounting surface on which the condenser 200 is mounted. Hereinafter, the drain structure for the condensate water condensed at the periphery of the opening part 210 is in detail described.

Figure 3:
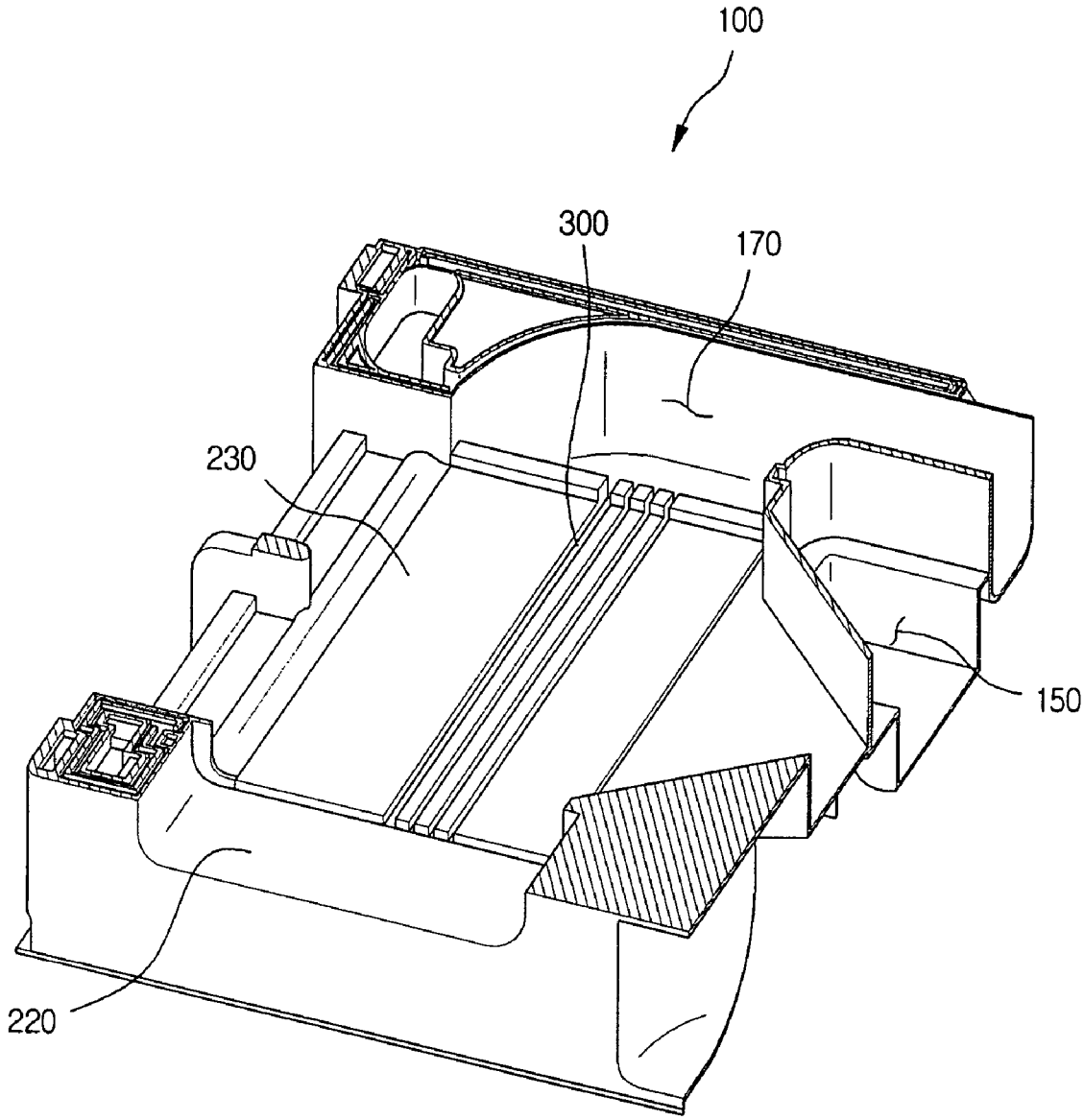
FIG. 3 is a perspective view illustrating a base taken along line I–I' of FIG. 2.

FIG. 3 is a perspective view illustrating the base taken along line I–I' of FIG. 2.

Referring to FIG. 3, the inventive drain structure of the dryer includes the front sealing mounting surface 220 for collecting the condensate water; the condenser mounting surface 230 for mounting the condenser 200 at a rear side of the front sealing mounting surface 220; and at least one drain 300 lengthwise provided from front to rear of the condenser mounting surface 230. Additionally, the front sealing mounting surface 220 is positioned at a lower surface of the opening part 210. Additionally, a front sealing (not shown) is disposed at an upper side of the front sealing mounting surface 220 to allow the air introduced through the circulation air falling part 110 to be directed to the condenser 200.

The front sealing is positioned in front of the condenser 200 such that the circulation air falling to the circulation air falling part 110 is guided to the condenser 200. Additionally, the front sealing has a curved surface at its rear, and the curved surface is mounted at a front lower end of the condenser 200. Accordingly, the falling circulation air is smoothly moved to the condenser 200 along the curved surface of the front sealing.

Alternatively, a depth of the drain 300 corresponds to a stepped height ranging from the condenser mounting surface 230 to the front sealing mounting surface 220. Of course, the drain 300 can also be deepened, but there is a drawback in that its manufacture process is complicated. Therefore, the drain 300 is preferably formed to have the same depth. However, the drain 300 can be more deepened, but if the drain 300 is shallow in depth, there is a drawback in that drainage is not performed.

By forming the drain 300, the condensate water collected at the front sealing mounting surface 220 flows along the drain 300 to reach a bottom surface of the circulation air passage 170. Additionally, the air reaching the bottom surface of the circulation air passage 170 is merged with the condensate water running down from the condenser 200, to move to the condensate water storage unit 150.

Here, while the dryer is operated to allow the circulation air to flow from the condenser 200 to the circulation air passage 170, the front sealing mounting surface 220 gets to be at a lower pressure than the circulation air passage 170. Accordingly, even though the drain 300 is not slantingly formed going from front to rear, the condensate water collected at the front sealing mounting surface 220 flows, due to a pressure difference, toward the circulation air passage 170 along the drain 300.

Figure 4:
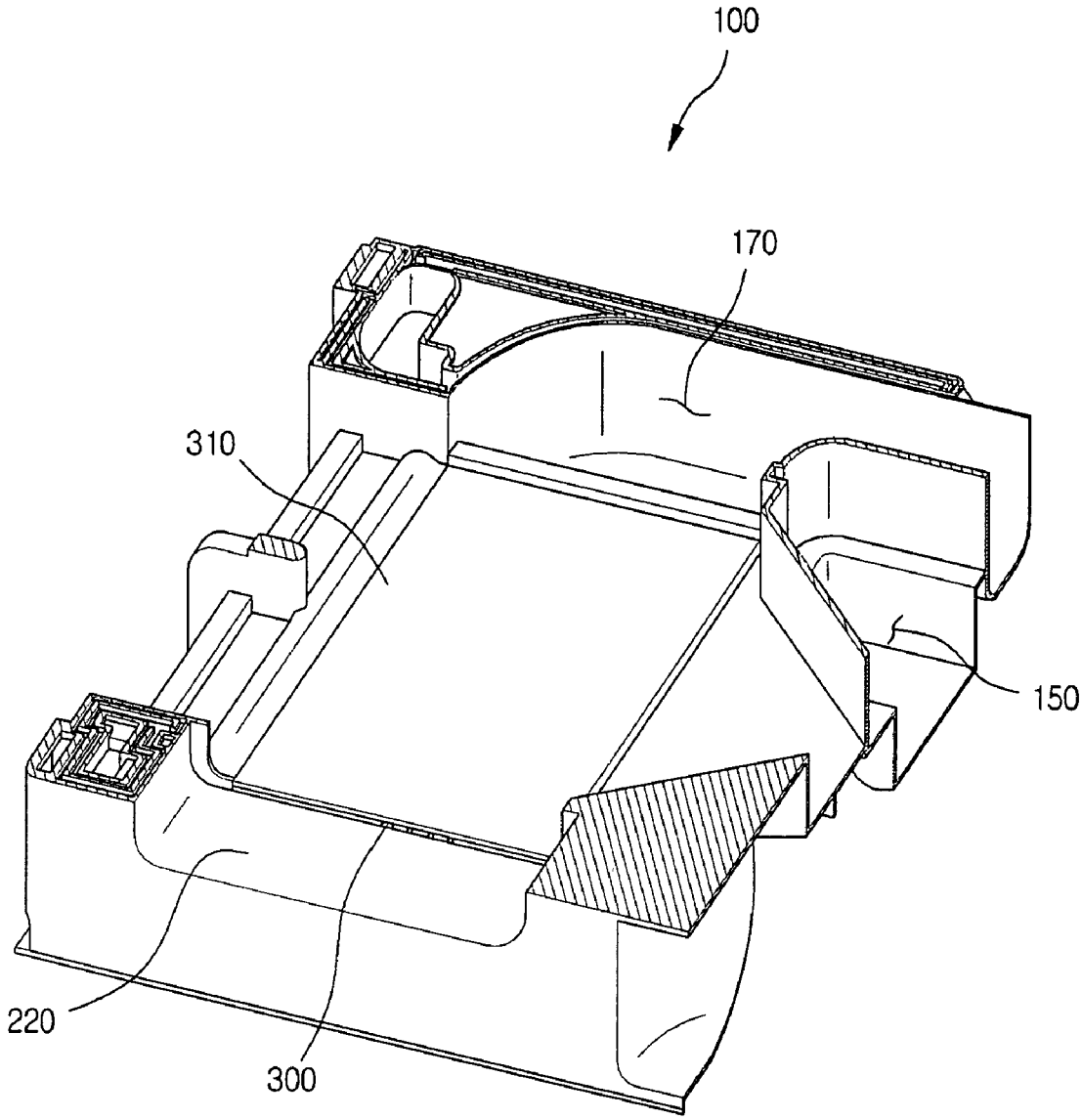
FIG. 4 is a perspective view illustrating a drain structure according to another embodiment of the present invention.

FIG. 4 is a perspective view illustrating a drain structure disposed down a condenser, according to another embodiment of the present invention.

Referring to FIG. 4, the inventive drain structure includes a drain 300 ranging from a front sealing mounting surface 220 to a circulation air passage 170; and a drain cover 310 covering the drain 300. Additionally, a condenser 200 is mounted on the drain cover 310.

By mounting the drain cover 310 on the drain 300, the drain 300 is not exposed to the exterior. Therefore, a consumer's esthetic sense can be enhanced.

Figure 5:
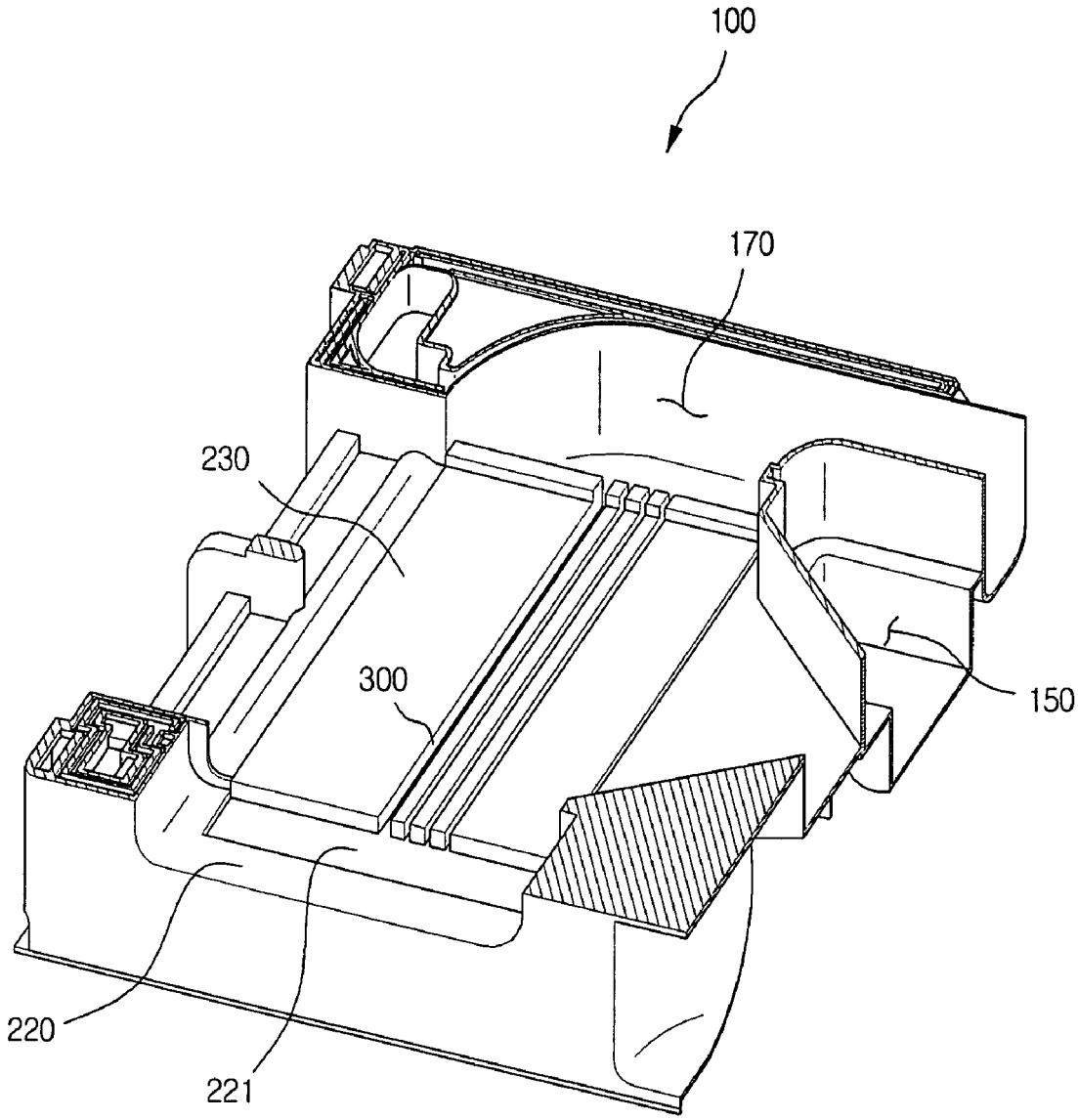
FIGS. 5 and 6 are perspective views illustrating a drain structure according to a further another embodiment of the present invention.
Figure 6:
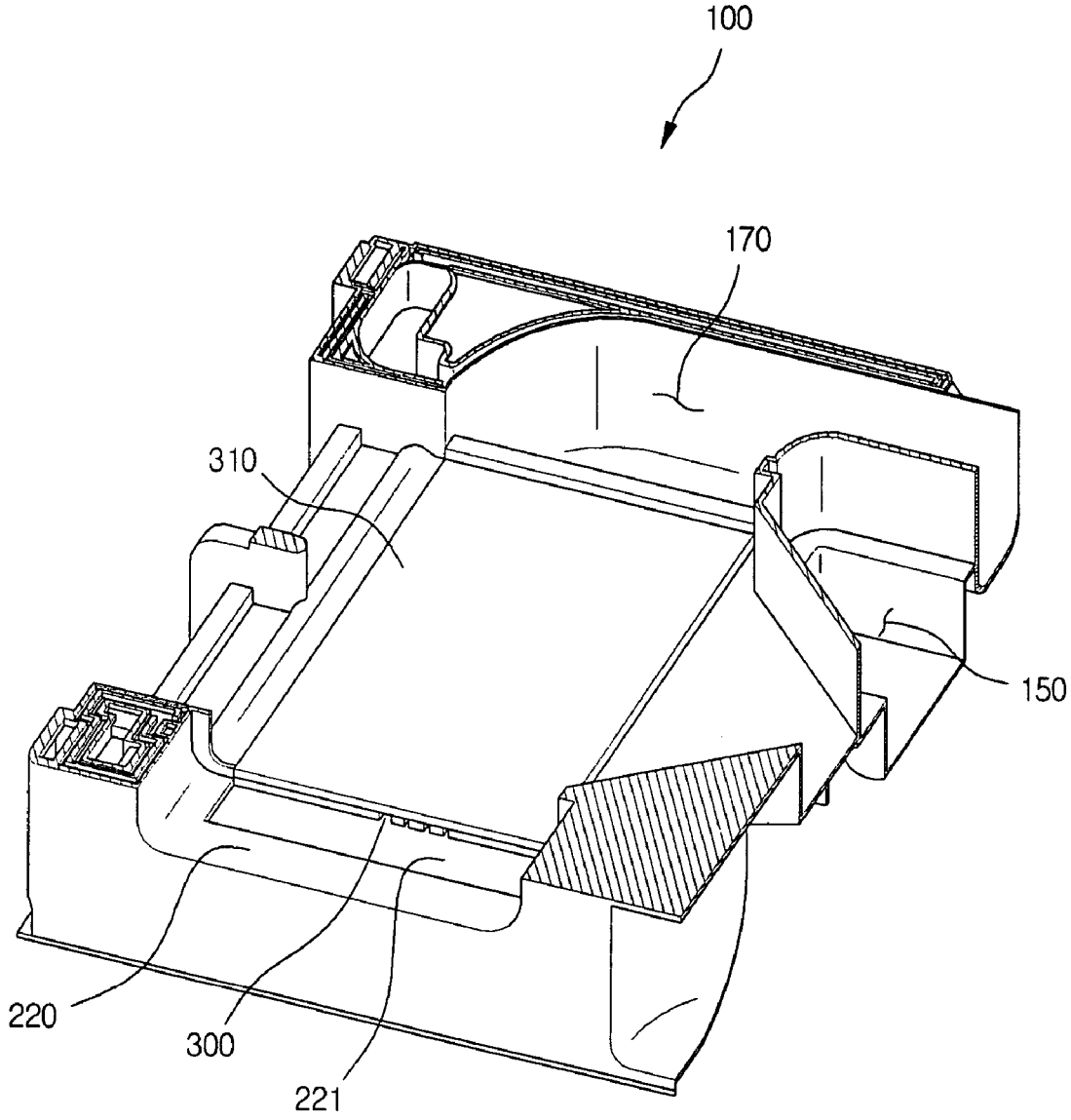

FIGS. 5 and 6 are perspective views illustrating a drain structure according to a further another embodiment of the present invention.

Referring to FIGS. 5 and 6, the inventive drain structure includes a front sealing mounting surface 220; a pocket 221 having a predetermined concaved depth and width on the front sealing mounting surface 220; and a drain 300 having a depth ranging from a bottom surface of the pocket 221 to the condenser mounting surface 230, and lengthwise disposed from front to rear of the base mounting surface 230.

As described above, some of the air falling to the circulation air falling part 110 is not moved to the condenser 200, but flows to the front sealing mounting surface 220.

Additionally, if the circulation air flowing to the front sealing mounting surface 220 is cold, the condensate water is generated. The pocket 221 is a concave part for more reliably preventing the condensate water from leaking out.

Accordingly, the drain 300 is provided to have the same depth as a bottom surface of the pocket 221 such that the condensate water collected in the pocket 221 is moved toward the circulation air passage 170.

Alternatively, as shown in FIG. 6, the cover 310 can be mounted on the drain 300.

As described above, the present invention has an advantage in that, by disposing the drain 300 down the condenser and selectively providing the drain cover 310, the condensate water is not leaked out from the front sealing mounting part and is smoothly moved to the condensate water storage unit 150 along the drain passage 300, thereby preventing the leakage of the condensate water.

The inventive drain structure of the dryer has an effect in that the condensate water condensed at the periphery of the condenser is not leaked out. Specifically, the inventive drain structure of the dryer has an advantage in that since the condensate water condensed at a periphery of the front sealing and at a front of the condenser can be guided to the drain of the condenser together with other condensate water, the condensate water is prevented from leaking out at the front of the dryer.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dryer comprising:

a cabinet;

a drum housed inside of the cabinet;

a motor for providing a rotary force to the drum;

a belt for connecting a driving shaft of the motor with the drum;

a base disposed at a lower side of the drum;

a condenser mounted on the base, and allowing a high humid air passing through the drum and an indoor cold air to be in contact with each other to provide condensate water; and a drain lengthwise concaved from front to rear of a condenser mounting surface, which is provided on the base and mounts the condenser thereon, for draining the condensate water from a periphery of the condenser.

2. The dryer according to claim 1, wherein the base has an opening part at its front to insert the condenser from front to rear of the dryer.

3. The dryer according to claim 1, wherein a stepped front sealing mounting surface is provided in front of the condenser mounting surface.

4. The dryer according to claim 1, wherein the drain has the same depth as a front part of the condenser mounting surface.

5. The dryer according to claim 1, further comprising a cover provided at an upper side of the condenser mounting surface.

6. The dryer according to claim 1, further comprising a pocket provided in front of the condenser mounting surface to collect the condensate water.

7. The dryer according to claim 1, wherein the periphery of the condenser is a front part of the condenser.

8. The dryer according to claim 1, wherein the periphery of the condenser is positioned to have a lower height than the non-peripheral part of the condenser.

9. The dryer according to claim 1, wherein the drain has plural drain lines.

10. The dryer according to claim 1, including means to change direction of the high humid air at the front part of the condenser to be introduced to the condenser.

11. A drain structure of a dryer, the structure comprising:

abase;

a condenser mounting surface provided to have a predetermined depth from front to rear of the base, and for mounting a condenser thereon;

a front sealing mounting surface provided in front of the condenser mounting surface, and positioned to be lower than the condenser mounting surface; and at least one drain having a depth at least corresponding to a step between the condenser mounting surface and the front sealing mounting surface, and lengthwise provided from front to rear of the condenser mounting surface.

12. The structure according to claim 11, further comprising a cover provided at an upper side of the condenser mounting surface.

13. The structure according to claim 11, further comprising a pocket provided at the front sealing mounting surface to collect the condensate water.

14. The structure according to claim 13, wherein the pocket is in contact with the drain.

15. The structure according to claim 11, wherein the drain has plural drain lines.

16. The structure according to claim 11, wherein the drain has the same unevenness.

17. A drain structure of a dryer, the structure comprising:

a dryer base;

a condenser mounted on entirely within the base; and a drain concaved from front to rear of a condenser mounting surface, which is provided on the base and mounts the condenser thereon.

18. The structure according to claim 17, wherein the drain has an inlet port for a high humid air at its front.

19. The structure according to claim 17, wherein the drain has an outlet port for condensate water of the condenser at its rear.

20. The structure according to claim 17, further comprising a pocket concaved at the base of a front part of the drain, for collecting the condensate water.

21. A drain structure of a dryer, the structure comprising:

a dryer base;

a condenser mounted on the base; and a drain grooved from front to rear of a condenser mounting surface, which is provided on the base and mounts the condenser thereon.

* * * * *